US006705859B2

(12) United States Patent
McCarty

(10) Patent No.: US 6,705,859 B2
(45) Date of Patent: Mar. 16, 2004

(54) TAPERED GRIZZLY BARS FOR LIME KILN

(75) Inventor: Royce G. McCarty, Cumming, GA (US)

(73) Assignee: Andritz Inc., Glens Falls, NY (US)

( * ) Notice: Subject to any disclaimer, the term of this patent is extended or adjusted under 35 U.S.C. 154(b) by 3 days.

(21) Appl. No.: 10/373,862

(22) Filed: Feb. 27, 2003

(65) Prior Publication Data

US 2003/0165788 A1 Sep. 4, 2003

Related U.S. Application Data

(60) Provisional application No. 60/361,083, filed on Mar. 1, 2002.

(51) Int. Cl.[7] ..... F27B 7/14
(52) U.S. Cl. ..... 432/118; 241/183
(58) Field of Search ..... 432/103, 118, 432/119; 241/181, 183; 110/336

(56) References Cited

U.S. PATENT DOCUMENTS 4,569,659 A * 2/1986 Olsen et al. ..... 432/119
4,668,183 A * 5/1987 Patterson ..... 432/80
4,993,942 A * 2/1991 Boyden et al. ..... 432/14
5,664,882 A * 9/1997 Green et al. ..... 366/25

OTHER PUBLICATIONS

Four photographs of prior art "Grizzly Bar Device".

* cited by examiner

*Primary Examiner*—Gregory Wilson
(74) *Attorney, Agent, or Firm*—Nixon & Vanderhye, P.C.

(57) ABSTRACT

A grizzly bar device for a rotating kiln having an annular array of bars having at least two adjacent bars, wherein the thickness the bars is reduced in lateral and radial directions, and gap between the adjacent bars increases in width as the bars extend laterally from front to back of the bar and extend radially inward of the kiln. Another taper on a front face of the bars provides a cutting corner on each bar.

24 Claims, 5 Drawing Sheets

TAPERED GRIZZLY BARS FOR LIME KILN

RELATED APPLICATION

This application is related to and claims priority from U.S. Provisional Patent Application No. 60/361,083, filed Mar. 1, 2002, the entirety of which application is incorporated by reference.

BACKGROUND OF THE INVENTION

The present invention relates generally to a grizzly bar device that reduces the size of large lime stones inside a lime kiln. Grizzly bar devices are generally an annular array of teeth-like bars at the lower end of a lime kiln. The bars allow lime pebbles to pass out of the kiln, while retaining large lime stones in the kiln until the large stones are broken into smaller stones. The individual bars of the novel grizzly bar device disclosed herein have tapered surfaces on their flanks (sides) that reduce the tendency of large lime stones becoming caught between the bars, and a tapered front surface to assist in cutting the stones into lime pebbles.

As shown in FIG. 1, a lime kiln 10 is typically a long, hollow combustion chamber cylinder. The diameter of the kiln cylinder is typically 8 feet to 15 feet, and the kiln length is typically 150 feet to 450 feet. The cylinder is conventionally formed of a steel shell having a thickness of three-quarters (¾) of an inch to three and one-half (3.5) inches (2 cm to 9 cm). The kiln cylinder has a slight slope 12, of 1 to 3 degrees for example. The cylinder rotates slowly at, for example, one revolution per minute (RPM). A stationary burner 14 projects a flame into the interior of the kiln to heat the raw material 16.

Raw material 16, such as calcium carbonate ($CaCO_3$) or lime mud, is fed into the upper end 18 of the kiln. The slow rotation of the kiln and its slope 12 cause the raw material to tumble from the inlet, through the kiln, towards the lower kiln end 20. The flame from the burner 14 causes a chemical reaction that converts the raw material 16, e.g., calcium carbonate or lime mud, into calcium oxide (lime) and gaseous carbon dioxide. The lime generated in the kiln by the chemical reaction is typically in pebble form. However, the lime tends to be sticky at the elevated temperatures of 1500° F. to 1800° F. (815° to 982° C.) in the kiln. Accordingly, the lime pebbles and lime dust in the kiln can form into larger lime stones.

Large lime stones are broken down to smaller diameter stones and pebbles by the tumbling of the stones in the kiln. The stones are preferably broken down to a nominal size of 5 to 7 inches (12 to 18 cm) or less before the lime is conveyed from the lime kiln to a typical secondary power lime lump crusher. The crusher will further reduce the nominal size of the lime stones to a reduced size, such as 5 inches in diameter or less. The smaller diameter pebbles move from the kiln into and through a floor grate 22, having a typical 10 inch (25 cm) square pattern. The floor grate is adjacent the outlet of the kiln.

In kilns without a grizzly bar device, lime stones fall onto and get stuck on the floor grate 22. The large stones are broken up manually before falling through the grate 22 and into the lump crusher. Human workers stand at the end of a kiln to break lime stones stuck in the grate 22. The workers are in danger of being burned from the radiant heat of the flame of the burner 14, burned from an accidental back draft of the flame, and of being hit by falling lime stones lifted and dropped by the conventional grizzly bars 24 on the rotating kiln. For sake of safety, it is preferable that large stones not become caught in the grate 22. There is also a desire to reduce the need to dedicate operator resources to unplugging the grate 22.

A conventional grizzly bar device 24 breaks large lime stones into smaller stones, before the stones are discharged from the kiln. A grizzly bar device is generally positioned at the end 20 of a kiln to prevent large lime stones from being discharged from the kiln. In a conventional grizzly bar device 24, the bars are equally thick and extend radially inward into the kiln. The gap between adjacent bars decreases from the base to the tip of the bars, because the bars are aligned along radial lines that converge on the axis of the kiln. The converging gap between the bars prevent large lime stones from exiting the lime kiln without first being broken up by the tumbling action of the rotating kiln. Conventional bars "pinch" lime stones having a size about the same as the gap between the equally thick bars. A stone becomes "pinched" by sliding partially between two bars and becoming stuck in the grizzly bar device.

As the conventional grizzly bars rotated with the kiln, the pinched lime stones were lifted upwards within the kiln. The pinched stones often fell as they were lifted over the burner tube 26 that extends into the end of the lime kiln and along the centerline 28 of the kiln. These relatively-heavy lime stones have been known to fall onto and damage the burner tube (which typically is operating at a very hot 1800° F.). When they fall, the large lime stones have also caused personal injury to workers near the kiln.

Pinched stones, that did not fall when lifted over the burner, have been known to eventually plug all the bars of the grizzly bar device. The pinched stones remain stuck between the bars until they are manually removed or until they fall out from between the bars, which are at the top of the kiln. Conventional bars of a grizzly bar device also allow hot lime dust to remain stationary on the flank of the bars. With time, the accumulation of pinched stones and dust on the bars can block the entire circumference of the grizzly bar device.

A completely plugged grizzly bar device creates a dam at the end 20 of the kiln that prevents the gravity flow of lime out of the kiln. The dam formed by the grizzly device allows the lime product to flood the downhill end of the kiln and allows large stones to flow over the radial bars and out the kiln. These large stones plug the floor grate 22 below the kiln discharge and can excessively allow large stones to enter and damage the lump crusher device. Accordingly, there is a long felt need for a grizzly bar device that does not pinch lime stones and does not become clogged.

SUMMARY OF THE INVENTION

A grizzly bar device of the present invention has a double taper on the flanks of its individual bars to prevent stones greater than a nominal diameter, such as five to seven inches in diameter, from exiting the lower end of the kiln. The double taper of the flank includes a first taper parallel to the kiln axis, which causes the bar to become narrower from front to back of the bars. The first (lateral) taper on the flanks causes the gap between bars to become wider from the front to back of the bars. The second (radial) taper on the bar flanks is near parallel to a radial line from the centerline 28 of the kiln and reduces the bar thickness from base to tip of the bars. The second taper on the flanks causes the gap between bars to increase in width from the base to the tip of the bars. The double tapered flanks of the bars prevents the pinching of stones by increasing the gap between bars in two directions. An optional third taper on the front face of individual bars forms a cutting edge on each bar to assist in breaking up large lime stones that roll against the grizzly bar device.

In one embodiment, the invention is a grizzly bar device for a rotating kiln comprising: an annular array of bars having at least two adjacent bars, wherein a thickness of each adjacent bar is reduced from the base to the tip of the bar wherein a gap between said adjacent bars increases in width from the base to the tip of the bars and from the front to the back of the bars. The first (lateral) taper on bar flanks is at an angle parallel to the kiln axis and may be in a range of 3° to 15°. The second (radial) taper on the bar flanks is at an angle to a radial line, and may be in a range of 5° to 15°. Moreover, the front face of each bar may have a cutting corner formed by front taper on the front face that extends from one flank to an opposite flank of an individual bar. The front taper on the front face may be at an angle in a range of 5° to 15°.

In another embodiment, the invention is an annular array of grizzly bars for a rotating kiln comprising: at least two adjacent bars, each bar having a front face and a rear face, wherein the thickness of each bar is reduced from the front to the rear face and also from the base to the tip of the bar, and each of said bars further including a tapered front face, wherein said front taper forms a cutting corner on said front face which is forward in said kiln with respect to an opposite corner of the front face. A gap between the adjacent bars increases in width from the front to the rear of the bars and as the bars extend radially inward of the kiln. The gap is formed by a lateral and radial taper on a flanks of the adjacent bars. The gap allows material that enters the bars to fall through the bars because the gap increases as the lime stones fall by gravity and rotation. A cutting taper on the front face of the bars is rotation sensitive, as the cutting action only works one way. The cutting taper is defined as a taper on the front of a bar, at the face deepest inside the kiln, such that there is a taper line away from a circumferential line from the centerline of the kiln. The cutting taper extends around the tip of the bar so that the top of the bar is also tapered.

DETAILED DESCRIPTION OF THE INVENTION

Figure 1:
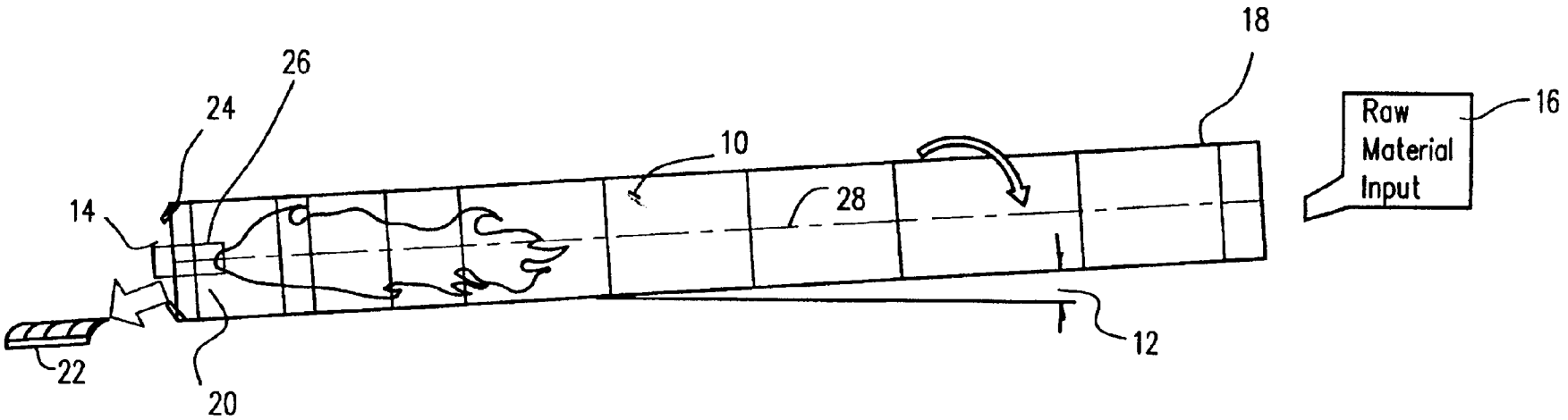
FIG. 1 is a schematic side view of a lime kiln with a grizzly bars device.
Figure 2:
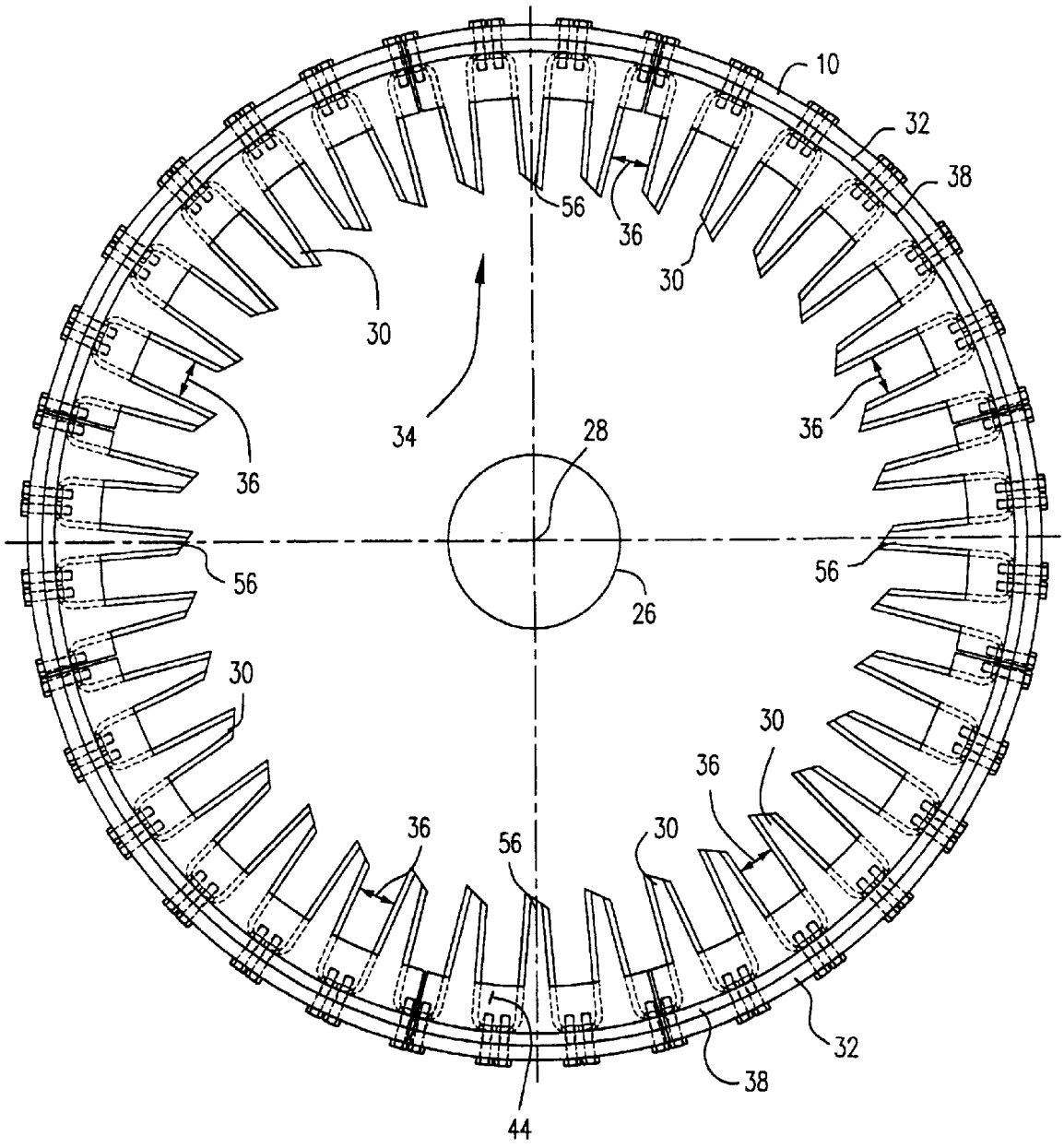
FIG. 2 is a rear view of a grizzly bar device in a kiln standing outside the kiln, and looking inside the kiln along the kiln centerline 28.
Figure 3:
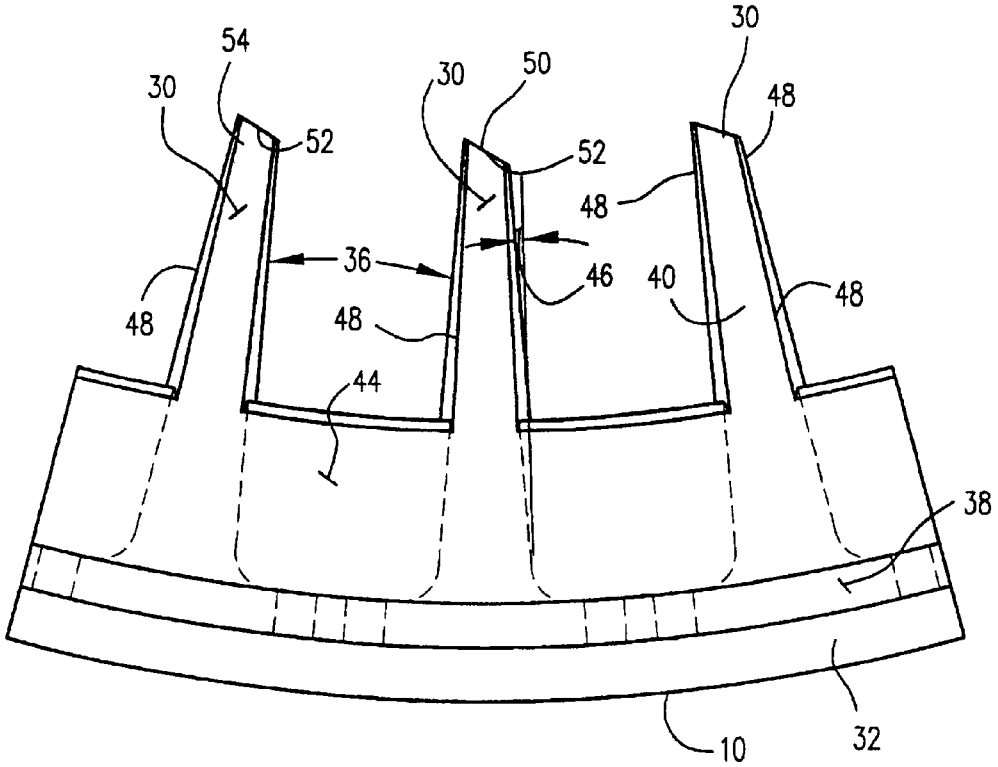
FIG. 3 is a rear view of three bars of the grizzly bar device shown in FIG. 2.

FIG. 2 is a rear view of a grizzly bar device 34 positioned at the end 20 of the kiln, in the same position as the conventional grizzly bar device 24 shown in FIG. 1. The device 34 includes an annular array of bars 30 projecting radially inward from the inside circumference 32 of the kiln 10. The grizzly bars 30 may be used on a standard rotary kiln 10. The kiln may not have satellite coolers or has satellite coolers and also has an overflow positioned downhill of satellite cooler discharge ports.

The bars 30 form an annular array of radial teeth that block large lime stones, e.g. stones having a diameter greater than five to seven inches, from tumbling out of the kiln. The gaps 36 between each pair of adjacent bars 30 prevents lime stones larger than a nominal size from tumbling out of the lower end of the lime kiln. The bars 30 form a filter that allows lime pebbles and stones having smaller than a nominal size, e.g., smaller than five to seven inches in diameter (15 to 18 cm), to flow through the gaps 36 between the grizzly bars 30 and out the end of the lime kiln.

As shown in FIGS. 3 to 8, the individual tapered grizzly bars 30 are spaced around the inside circumference 32 of the lower end of the kiln 10. Each bar 30 is mounted on an annular flange 38. The flange is attached to the inner circumference 32 of the lime kiln by bolts or other attachment means. The bars 30 may be formed integrally with the flange 38, or be separate bars attached to the flange. Each bar 30 extends radially inward from the flange 38 and towards the center line 28 of the lime kiln.

Figure 8:
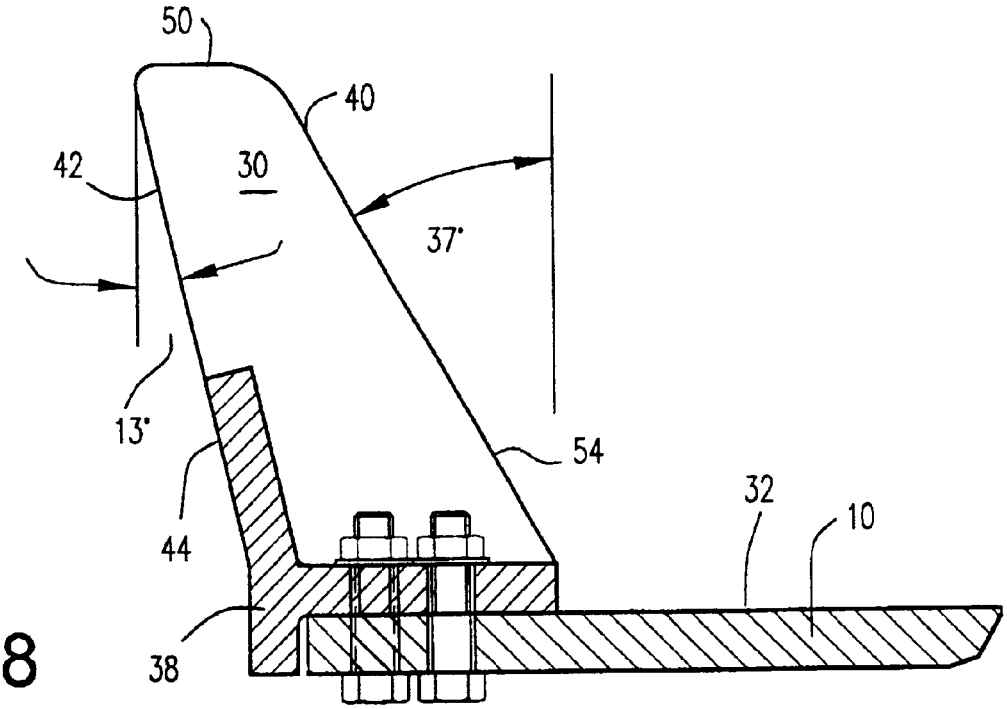
FIG. 8 is a side cross-sectional view of a grizzly bar mounted on an annular flange and an inside surface of the lime kiln.

The bars 30 have a conventional swept-back front surface with a swept back angle of 35° to 45° from a plane perpendicular to the kiln axis 28, (FIG. 8) on the front face 40 of each bar. The bars may also include a conventional swept-back trailing surface 42 having a taper of 10° to 15°. (FIG. 8). The swept back front surface 40 of the bars allows for the retention of larger lime stones, and the swept back rear surface 42 of the trailing surface allows extra reinforcement of the tip of the bar. A short wall 44 aligned with the rear surface 42 of the bars assists in retaining castable refactory raw material, which is either poured or rammed wet, and allowed to cure to a high hardness in the kiln. The short wall 44 also serves as a reinforcement between bars 30 to resist the roll-over torque of large stones impacting the bars during rotation of the kiln.

The flanks 48 (sides) of the bars 30 may be a generally planar surface having a lateral and radial tapers. Each bar has a first (lateral) taper 60 along at least one flank 48 (side) of the bar. The lateral taper 60 may form an angle in a range of 5 to 15 degrees with respect to a line parallel to the axis 28. The thickness of the bar is greatest at the front surface 40 and narrowest at the rear surface 42 due to the taper 60. Because the bars are thickest at the front surfaces 40, lime stones that fit between the gap 36 between the bars should not become stuck as the stones slide along the flanks towards the rear 42 of the bars.

Each bar 30 has a second (radial) taper 46 (FIG. 3) formed on the bar flanks 48. The radial taper 46 reduces the thickness of the bar from the annular flange 38 to the upper tip 50 of the bar. The radial taper 46 of the flanks 48 of each bar may be in a range of 5 to 15 degrees. Due to the radial taper 46, the width of the gap 36 increases as the bars extend radially inward towards the center of the kiln. Stones do not become pinched in the gap 36 as the kiln rotates because of the radial taper 46 on the flanks of the bars allows stones to easily slide out of the gap.

Due to the radial 46 and lateral 60 tapers on the flanks 48 of the bars 30, larger stones that roll between bars will tumble out of the gap 36 between the bars as the kiln rotates and well before the bars lift the stones directly above the burner tube 26. Larger stones continue to tumble inside the kiln until broken to a size that will pass between the bars. Accordingly, radial and lateral tapers on the flanks of the grizzly bars reduces the tendency of large lime stones being stuck between the bars.

Figure 4:
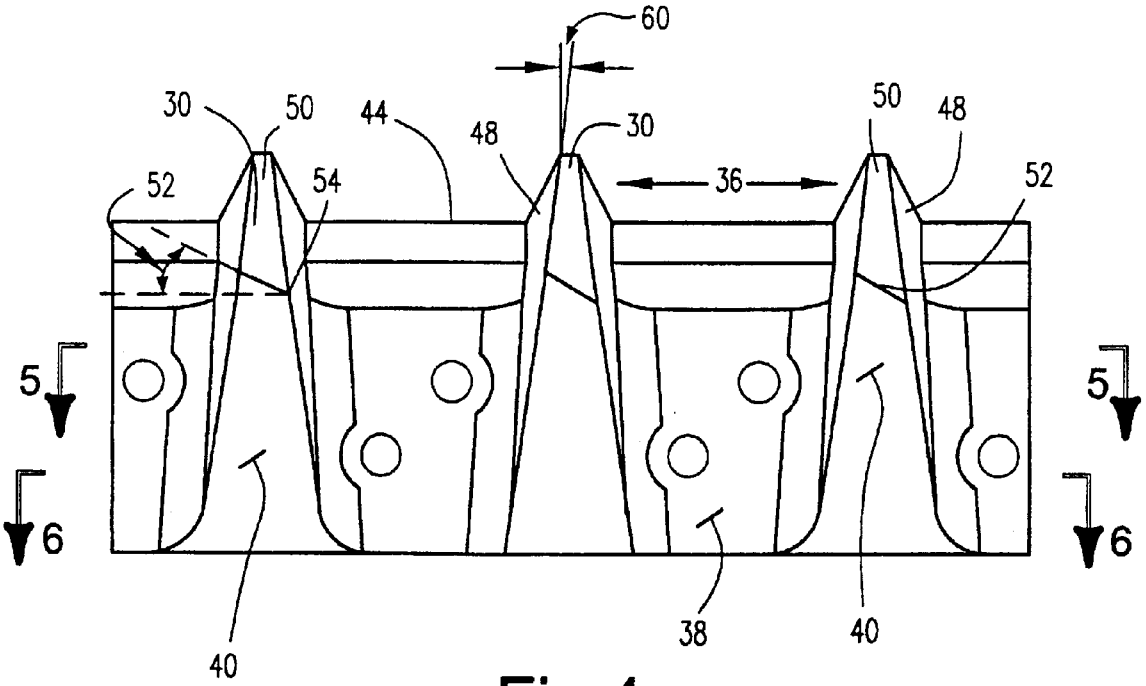
FIG. 4 is a perspective view of a section of three bars, none of which have a lifter.
Figure 5:
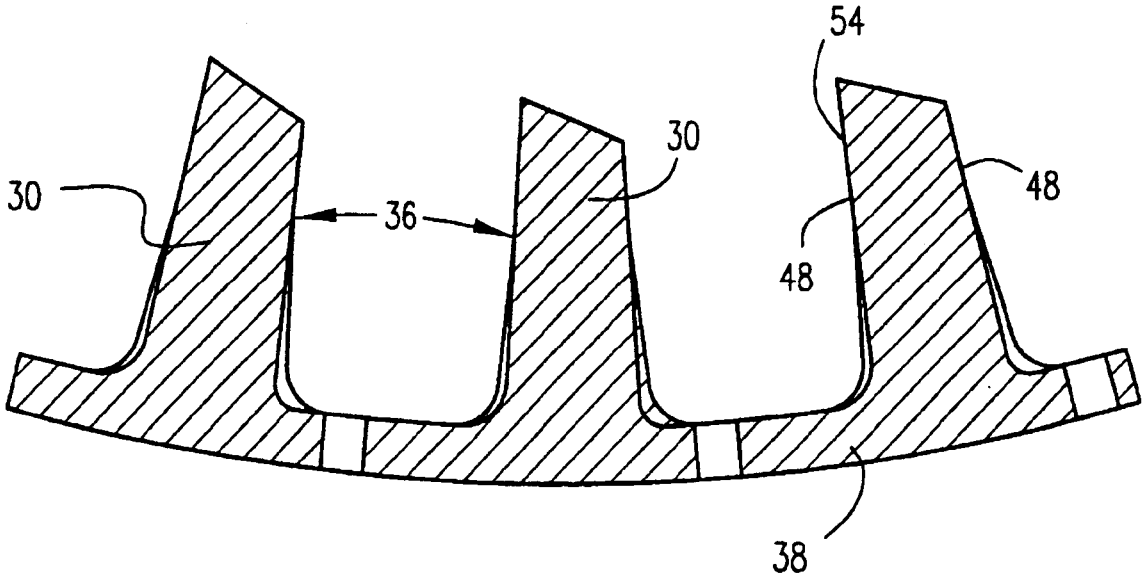
FIG. 5 is a cross-sectional view of the three bars shown in FIG. 5, where the cross-section is taken along line 5—5 of FIG. 4, and demonstrates the relative location of bolt holes in one plane.
Figure 6:
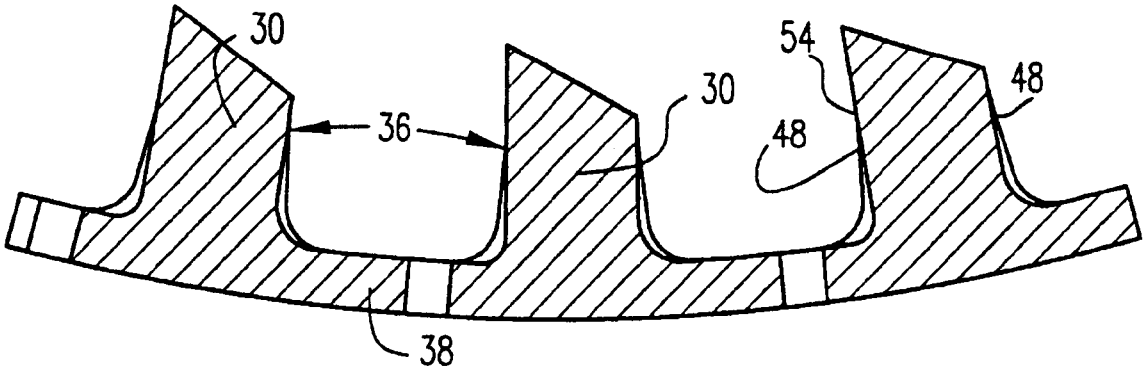
FIG. 6 is a cross-sectional view of the grizzly bars shown in FIG. 5, where the cross-section is taken along line 6—6 of FIG. 4, and demonstrates the relative location of bolt holes in a different plane.

As shown in FIGS. 2 and 4, a third taper (cutting taper) 52 may be applied to the leading surface 40 of each bar to sharpen a corner 54 of that surface 40. The cutting corner 54 on the front surface 40 of a bar first contacts the lime stones during rotation of the kiln. The cutting taper 52 applies an angle to the leading surface 40 in a range of 5 to 15 degrees from a plane perpendicular to the axis of the kiln and grizzly bar array. The sharp corner 54 formed by the third taper 52 provides a cutting action that assists in breaking up large lime stones in the kiln. The third taper 52 also assists in preventing residue (such as lime dust) from accumulating and plugging the gap 36 between bars 30 because the third taper deflects lime stones into the gap and thereby clears out residue in the gap. Further, the rolling action of stones slightly smaller than the gap between bars, tends to grind any lime dust buildup due to the added weight of these stones.

Figure 7:
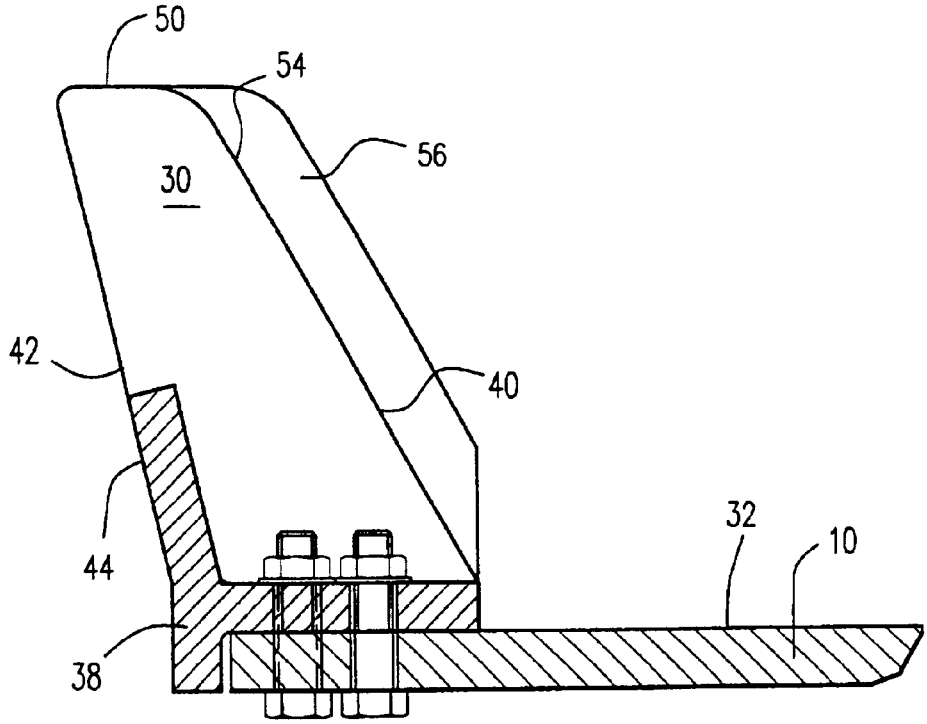
FIG. 7 is a side cross-sectional view of a grizzly bar, with a lifter, mounted on an annular flange and an inside surface of the lime kiln.

As shown in FIG. 7, some of the bars 30 in the grizzly bar array have a lifter 56 mounted on the front surface 40 of the bar. The lifter 56 is an extension on the bar. The lifter 56 may be only on, for example, four bars in the bar array (see FIG. 2). The four bars with lifters are symmetrically arranged around the kiln. The lifter assists in breaking larger stones that roll forcefully onto the lifter, and also lifts some larger stones so that they can fall from a higher elevation in the circumference of the kiln.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A grizzly bar apparatus for a rotating kiln comprising:

at least two adjacent bars extending radially inward of an inside surface of the kiln, said adjacent bars each have a front surface facing inward of the kiln and a rear surface facing outward of the kiln when said adjacent bars are mounted at or near a discharge end of the kiln, wherein each of the adjacent bars has thickness which reduces from the front surface to the rear surface along a line parallel to a kiln axis; and a gap between said adjacent bars which increases in width from the front surface to the rear surface of each of said adjacent bars, wherein said gap is in a plane generally perpendicular to the kiln axis.

2. A grizzly bar apparatus as in claim 1 wherein a flank of each of the adjacent bars has a lateral taper from the front surface to the rear surface, and said flank faces said gap.

3. A grizzly bar apparatus as in claim 2 wherein the flank has a radial taper along a radial length of each of said bars.

4. A grizzly bar apparatus as in claim 3 wherein the radial taper of the flank is tapered at an angle to a radial line to the kiln axis.

5. A grizzly bar apparatus as in claim 4 wherein the angle of the radial taper on the flank is in a range of 5 to 15 degrees to the kiln axis.

6. A grizzly bar apparatus as in claim 2 wherein the angle of the lateral taper is in a range of 5 to 15 degrees to the kiln axis.

7. A grizzly bar apparatus as in claim 2 wherein said flank of each of the bars has a radial taper and a lateral taper.

8. A grizzly bar apparatus as in claim 2 wherein opposite flanks of each of the adjacent bars have a radial taper and a lateral taper, and said opposite flanks are each on opposite sides of said gap.

9. A grizzly bar apparatus as in claim 2 wherein said front surface is tapered from one flank to an opposite flank to form a cutting corner on said front surface.

10. A grizzly bar apparatus as in claim 9 wherein the front surface is tapered at an angle in a range of 5 to 15 degrees from a plane perpendicular to said kiln axis.

11. A grizzly bar apparatus as in claim 1 wherein said front surface of each of the adjacent bars has a cutting corner.

12. A grizzly bar apparatus as in claim 11 wherein said front face is swept back from a plane perpendicular to said kiln axis.

13. The bar according to claim 1 wherein said adjacent bars are in a circular array of bars extending radially inward of an annular flange attached to an inner periphery of the kiln, and said circular array is in a plane perpendicular to said kiln axis.

14. The bar according to claim 13 wherein at least one bar of the array includes a lifter that is mounted on the front face of the at least one bar.

15. The bar according to claim 1 wherein each adjacent bar is positioned in an array that extends annularly around an inside circumference of the lower end of the kiln.

16. An annular array of grizzly bars for a rotating kiln comprising:

array of adjacent bars arranged in a plane perpendicular to a kiln axis, wherein each bar comprises a front face, a rear face and a flank extending from the front face to the rear face, wherein said flank from each bar faces a flank of the adjacent bar, each of said adjacent bars having a thickness reducing as the bar extends from the front face to the rear face and as the bar extends from a annular flange to an upper tip of the bar, and each of said adjacent bars further including a taper of the front face, wherein said taper forms a cutting corner on said front face, wherein said front face is oriented generally inward of the kiln and said rear face is oriented generally towards a discharge end of said kiln.

17. An annular array of grizzly bars as in claim 16 further comprising a gap between said adjacent bars, wherein the gap increases in width as the bars extend radially inward of the kiln and from the front surface to the rear surface of each bar, and said flank of each bar faces the gap.

18. A grizzly bar apparatus as in claim 16 wherein the flanks of the adjacent bars is tapered in a lateral direction parallel to the kiln axis and a radial direction with respect to the kiln axis.

19. A grizzly bar apparatus as in claim 18 wherein the flank is tapered continuously along a lateral length of the bar.

20. A grizzly bar apparatus as in claim 18 wherein an angle of the lateral taper on each flank is in a range of 5 to 15 degrees to the kiln axis.

21. A grizzly bar apparatus as in claim 18 wherein an angle of the radial taper on each flank is in a range of 5 to 15 degrees to a radial line to the kiln axis.

22. A grizzly bar apparatus as in claim 16 wherein the front face is tapered at an angle in a range of 5 to 15 degrees with respect to the plane perpendicular to the kiln axis.

23. A grizzly bar apparatus as in claim 16 wherein said front face is swept back with respect to the plane perpendicular to the kiln axis.

24. The bar according to claim 16 wherein each adjacent bar is positioned annularly around the inside circumference of a lower end of the kiln.

* * * * *